US006925761B1

(12) United States Patent
De La Marche

(10) Patent No.: US 6,925,761 B1
(45) Date of Patent: Aug. 9, 2005

(54) MODULAR BUILDINGS

(76) Inventor: Peter William De La Marche, Leafbrook Bungalow Leafbrook Lane, Monmouth (GB) NP25 3SN ( * ) Notice: Subject to any disclaimer, the term of this patent is extended or adjusted under 35 U.S.C. 154(b) by 0 days.

(21) Appl. No.: 09/720,895

(22) PCT Filed: Jul. 5, 1999

(86) PCT No.: PCT/GB99/02141

§ 371 (c)(1),
(2), (4) Date: Mar. 5, 2001

(87) PCT Pub. No.: WO00/01898

PCT Pub. Date: Jan. 13, 2000

(30) Foreign Application Priority Data

Jul. 3, 1998 (GB) ..... 9814332

(51) Int. Cl.[7] ..... E04H 1/00; E04H 14/00; E04H 3/00; E04H 5/00; E04H 6/00

(52) U.S. Cl. ..... 52/79.7; 52/79.8; 52/220.2; 52/236.3; 52/236.5; 52/234; 52/220.1

(58) Field of Search ..... 52/79.7, 79.8, 52/79.14, 79.13, 220.2, 127.1, 236.3, 236.5, 52/236.9, 79.9, 127.7, 281, 282.2, 282.3, 52/582.1, 586.1, 585.1, 79.1, 234, 220.1, 52/220.8

(56) References Cited

U.S. PATENT DOCUMENTS

| | | | | | |
|---|---|---|---|---|---|
| 1,723,306 | A | * | 8/1929 | Sipe | 52/582.1 |
| 3,112,579 | A | * | 12/1963 | Needham et al. | 52/79.8 |
| 3,292,327 | A | * | 12/1966 | van der Lely | 52/79.1 |
| 3,510,997 | A | * | 5/1970 | Ratych | 52/79.1 |
| 3,919,812 | A | * | 11/1975 | van der Lely et al. | 52/79.1 |
| 3,968,611 | A | * | 7/1976 | de Munck | 52/396 |
| 4,010,579 | A | * | 3/1977 | Galvagni | 52/79.8 |
| 4,599,829 | A | * | 7/1986 | DiMartino, Sr. | 52/79.7 |
| 4,644,708 | A | * | 2/1987 | Baudot et al. | 52/79.9 |
| 5,675,194 | A | * | 10/1997 | Domigan | 307/147 |
| 5,755,063 | A | * | 5/1998 | Ohnishi | 52/79.8 |
| 6,014,849 | A | * | 1/2000 | Yonemura | 52/586.1 |

* cited by examiner

*Primary Examiner*—Carl D. Friedman
*Assistant Examiner*—Chi Q. Nguyen
(74) *Attorney, Agent, or Firm*—Woodward, Emhardt, Moriarty, McNett & Henry LLP.

(57) ABSTRACT

A modular building structure comprises a service corridor (2) to which are connected separate cabin modulates (1) that form accommodation or offices etc. The service module contains apparatus for the supply and distribution of mains services such as water, electricity, waste disposal and air conditioning to the building modules. The modules are connected to the corridor and to said mains supply services. Each of the cabin modules is free-standing, pre-fitted for its intended use. Adjacent modules are interconnected by a flexible grommet (26) that extends between aligned apertures in each module.

34 Claims, 9 Drawing Sheets

MODULAR BUILDINGS

CROSS REFERENCE TO RELATED APPLICATIONS

This application is a Chapter II National Stage filing from PCT/GB99/02141, international filing date of 5 Jul. 1999, which claims priority to GB 9814332.4, filed 3 Jul. 1998.

FIELD OF THE INVENTION

The present invention relates to modular building and more particularly to their structure, the method of their construction and interconnection.

BACKGROUND OF THE INVENTION

It is well known to provide for portable modular building in circumstances where accommodation is needed in an emergency or on a temporary basis. Such buildings have to be rapidly and easily assembled to meet demand for emergency habitable structures in times, for example, of natural or other disasters. In addition such buildings are often required in remote locations by workers employed in the construction industry where temporary accommodation is needed during the term of the construction project.

There is a need for an all-purpose modular building system that can be exploited by both the residential and commercial construction sectors of industry. To date, portable and prefabricated buildings designs have not proved suitable for application in both sectors. Modular buildings have the advantages that they are easy and quick to erect, dismantle or relocate, are readily transportable, and flexible in that they are reconfigurable to meet changing requirements in size or needs. Unfortunately existing designs of such buildings are generally of a temporary nature and are not suited to long-term or permanent applications.

Existing modular buildings suffer from several disadvantages including: racking which causes wear and tear to the structure of the building and often leads to leaks, creaks and structural damage; condensation; inadequate interior temperature control; ineffective noise insulation; and an excessive ingress of dirt and dust (particularly in environments such as construction sites).

SUMMARY OF THE INVENTION

U.S. Pat. No. 3,742,666 describes a modular building construction in which a pre-fabricated module for utility supply systems such modules can be delivered in a pre-fitted state to the construction site and assembled with limited effort and time. The module has side wall openings by which it may be attached to building modules.

It is an object of the present invention to obviate or mitigate the aforesaid disadvantages and to provide a modular building construction that has improved life expectancy so that it meets the requirements of more permanent structures whilst maintaining the benefits of its modular nature. The term "building module" is used hereinafter to refer to an inhabitable building block that can be used as living quarters, an office, a conference room, a lavatory or washroom or another room that forms part of a larger building structure.

According to a first aspect of the present invention there is provided a modular building structure comprising a service module defining a plurality of connection nodes for connection to separate building modules, the service module containing apparatus for the supply and distribution of at least one mains service to the building modules, each building module being free-standing, pre-fitted for its intended use and connected to one of said connection nodes and to said supply of at least one mains service, wherein the service module is in the form of a corridor walkway linking the building modules.

The modular structure of the present invention provides for a very flexible arrangement in that once the service module has been installed on site the building modules can then be connected thereto in the desired number and fashion. If there is a demand for more building modules these can be simply added without the need to lay further mains service supplies. Similarly, removal of a particular building module is also a simple operation. As the mains service supply is contained within the service module the need for preliminary ground excavation is eliminated. Moreover little or no foundations are required.

The corridor may conveniently be provided with floor and ceiling cavities in which the mains service supplies are routed. Preferably one building module is a dedicated plant room that feeds the mains supply service to the service module.

The service module is preferably sectional so that it can be extended or shortened to provide more or less connection nodes as required. More than one service module may be provided and they may extend in transverse directions. The mains service may be electricity, waste disposal, air conditioning, water etc. In the case of waste disposal, each service module is provided with a holding tank and is connected to a lavatory or wash area of an adjacent building module. Preferably the holding tanks of adjacent sections of a service module are connected by a suction waste pipe. The arrangement eliminates the need for gravity operated waste disposal. In the case of air conditioning each service module is preferably fitted with a heat exchanger and has an external pump for evacuation of warm air. Each building module also has its own heat exchanger that is connected to the pump and heat exchanger of the adjacent service module.

Preferably each adjoining pair of building modules or service modules have apparatus for connecting adjacent modules, the apparatus comprising a housing defining apertures that extend into the structure of each module and a flexible resilient insert that is received in each aperture and bridges the two modules, the insert being supported on a fixing element that is secured to each of the modules.

According to a second aspect of the present invention there is provided a method for constructing a modular building structure, the method comprising the steps of: preparing a site on which the building structure is to be located; installing a service module on the prepared site, the service module defining a plurality of connection nodes for connection to separate building modules; installing at least one mains supply service to the service module; connecting at least one pre-constructed building module to a connection node and connecting the building module to the mains supply service of the service module; and furnishing the service module such that it is in the form of a corridor walkway linking the building modules.

According to a third aspect of the present invention there is provided an apparatus for connecting adjacent building modules, the apparatus comprising a housing defining an aperture that extends into the structure of at least one building module and a flexible resilient insert attached to adjacent module, the insert being that is received in the aperture and supported on a fixing element that is secured to said adjacent building module.

The housing preferably further comprises an access chamber that is open to the inside of the building module so as to facilitate insertion of the fixing element and flexible insert.

Preferably the apparatus for connecting adjacent building modules is disposed in a floor or ceiling cavity of the building module.

DESCRIPTION OF THE DRAWINGS

Specific embodiments of the present inventions will now be described, by way of example only, with reference to the accompanying drawings in which.

DESCRIPTION OF THE PREFERRED EMBODIMENT

Figure 1:
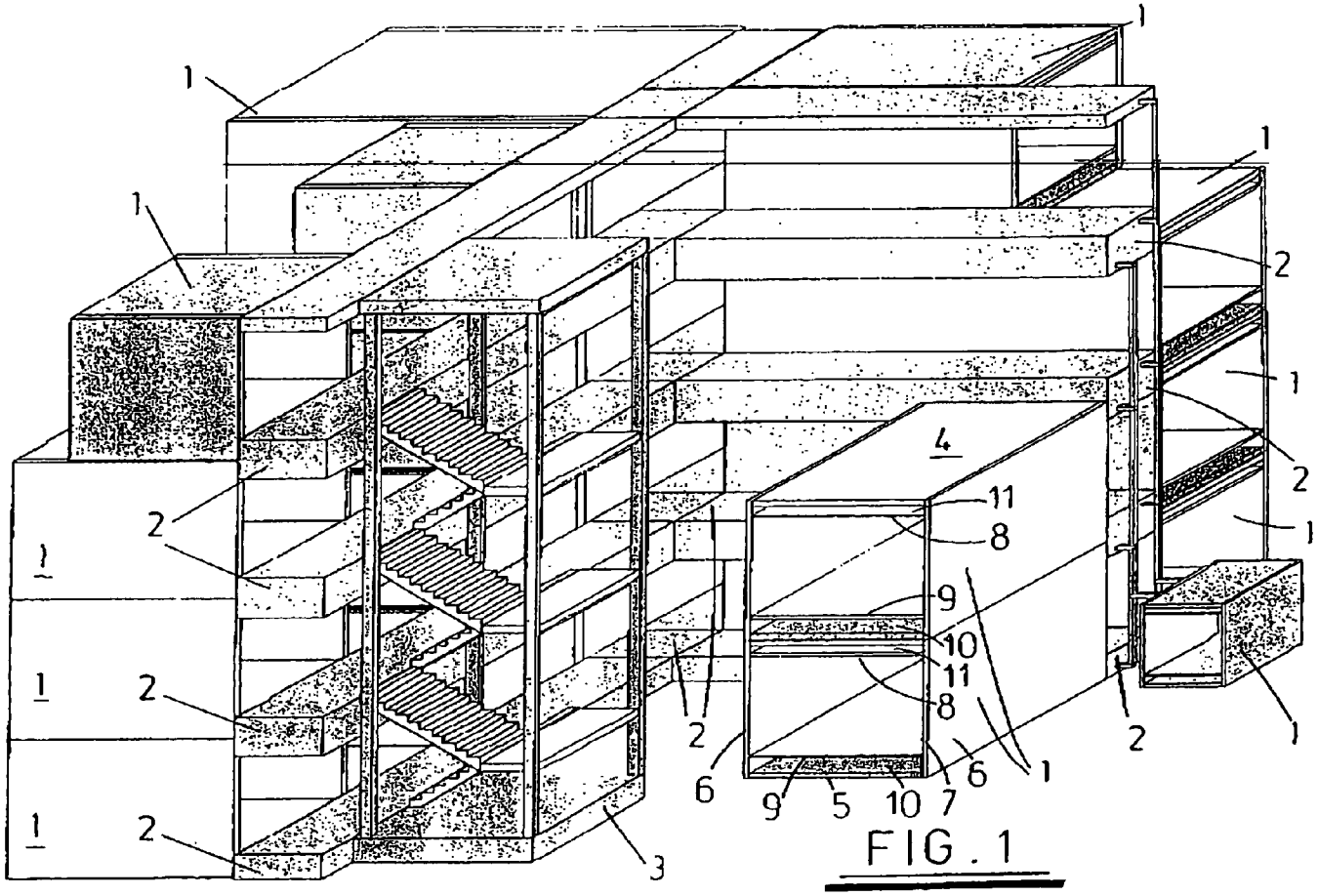
FIG. 1 is a perspective view of a modular building structure of the present invention constructed from a plurality of interconnected modules with certain panels removed for clarity.

Referring now to the drawings, FIG. 1 shows an exemplary modular building structure comprising a plurality of cabin modules 1 interconnected by corridors 2. The cabin modules 1 are designed to be furnished and used as, for example, offices or living quarters whereas the corridors 2 form passageways that, in addition to providing walkways between cabin modules 1, carry and distribute service supply lines to the cabin modules 1. The building shown has multiple storeys that are interconnected by a stairwell 3 in the foreground.

For the purposes of clarity end walls of the cabin modules 1 and all corridor walls are not shown. The only parts of the corridor shown are the floors and ceilings (which are combined on intermediate storeys).

The building structure is assembled from the cabin modules 1 and corridors 2 using the known honeycomb principle in which there is no overall super-structure and the integral strength of the structure is shared by each module both laterally and vertically so that should one module fail the load is taken up by adjacent modules. It will be seen from the drawing of FIG. 1 that the cabin modules 1 can be of different sizes although they are of the same basic construction. The cabin and corridor modules 1,2 can be designed in a range of standard sizes to allow for different building types and configurations to be assembled from factory produced units. The corridors 2 have the same basic construction as the cabin modules 1 but are adapted to have different end sections and different below floor or above ceiling structures. The modules 1 are interconnected in a fashion that makes them easy to replace or exchange so that the building can be updated or regenerated at any time.

The modular structure of the buildings ideally suited to office buildings, hotels, schools, light industrial sites as well as residential buildings. It is not at this stage intended for buildings of a more significant size such as large factories, warehouses, stadiums and theaters etc.

The present invention is concerned with the structure and method of construction of the building structure and the manner in which the cabin modules 1 are fastened together.

Each cabin module 1 comprises a tetragonal box assembly having top, bottom and side walls 4,5,6 and open ends 7. The module 1 may be constructed in a range of different heights, lengths and widths. The tetragonal structure provides strength without end walls being necessary and without the need for expensive superstructures or foundations.

Each cabin module 1 is fitted with an internal suspended ceiling and floor 8, 9 so as to define enclosed cavities 10, 11. The cavities 10, 11 accommodate service supplies, ventilation equipment, concealed lighting and other ancillary equipment.

Figures 2, 3, 4:
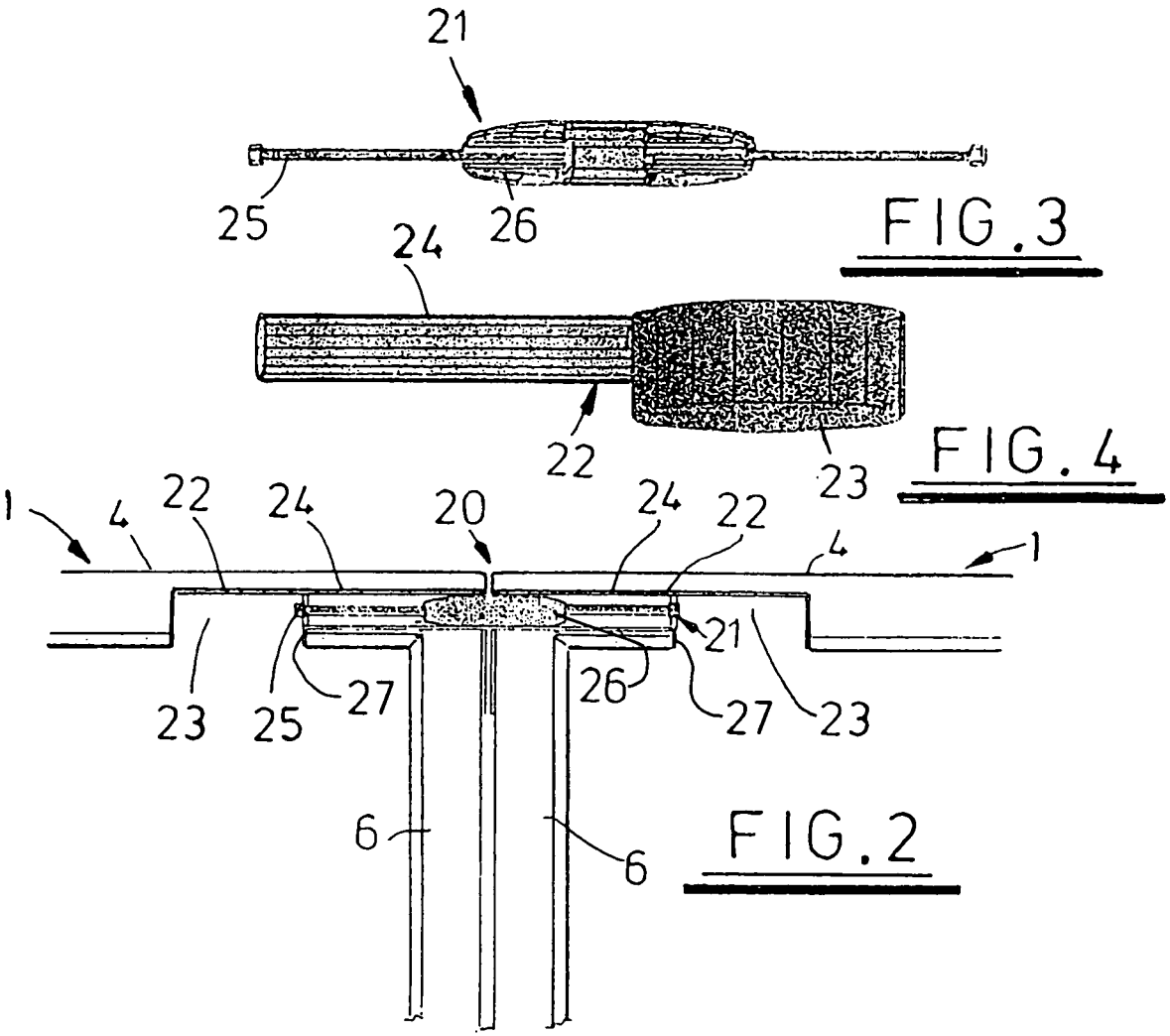
FIG. 2 is a sectioned side view of the intersection of two modules showing connecting points and a fixing assembly.
FIG. 3 is a side view of a grammar of the fixing assembly shown in FIG. 2.
FIG. 4 is a side view of a grommet housing of the connecting point shown in FIG. 2.

Each cabin module 1 has a plurality of connection points 20 (see FIG. 2) disposed at regular intervals at the top and bottom of all four walls 4, 5, 6 and at open ends of the cabin. The connection points 20 permit adjacent cabin modules 1 to be connected together by fixing arrangements 21 (see FIG. 3) that are secured from inside the floor or ceiling cavities 10, 11 and are defined by housings 22 (one shown in FIG. 4) disposed on the floor and ceiling cavities 10, 11. Each housing 22 has a circular access chamber 23 that is open to the interior of the cabin and an elongate bore 24 extending radially from the access chamber 23 and out through a wall or an end frame of the cabin module 1. The fixing arrangement 21, shown in FIG. 3, comprises a double-headed fastening bolt 25 that carries a resilient but flexible grommet 26 of elastomeric material such as Neoprene or EPDM and two collars 27 each side of the grommet 26. In use the grommet 26 and bolt 25 extend into the aligned elongate bores 24 of the connection point housings 22 of adjacent cabin modules 1 so as to connect two cabin modules 1 together. FIG. 2 shows the fixing arrangement 21 being used to connect together two cabin modules 1 side by side. The same arrangement is used to secure cabin modules 1 in vertical array, end-to-end or to connect corridor modules 2 to cabin modules 1. The open access chamber 23 of the housing 22 allows the fixing arrangement 21 to be easily inserted or removed.

The flexible and resilient nature of the grommet 26 permits adjacent cabin modules 1 to be coupled together without the requirements for their absolute alignment and without the fixing arrangement 21 becoming damaged or causing damage to the rest of the structure. This is essential for rapid construction of the building structure. Moreover, it allows easy reconfiguration, relocation or dismantling of the building structure. The fixing arrangement 21 provides primarily horizontal fixing strength but also partial vertical strength. The same connection point 20 and fixing arrangement 21 may be used to secure ancillary molecules such as fire escapes, verandas stairwells etc. to the cabin or corridor modules.

It will be understood that the provision of multiple correction points 20 on each module permits selective use of those points that are appropriately positioned for each connection.

When cabin modules 1 are stacked on top of each other they are secured in a vertical direction by means of a half grommet fixing arrangement 30 that is fixed to the upper surface of the cabin module 1 or a supporting frame member.

Each grommet 30 is moulded, at one end, around a protruding metal screw 30*a* that engages in a threaded aperture 30*b* in the cabin module or frame member. The other end has an axial opening which securely receives a bolt 30*c*. A collar such as one of those shown in FIG. 3 may be disposed on the bolt 30*c*.

The modules are lifted and placed on top of one another so that each half grommet fixing arrangement 30 is received in an aperture in the bottom wall of the cabin module 1 or supporting frame member above. The half grommet fixings 30 are then secured in place to an appropriate fixing plate via the collar under the floor cavity 8 of the cabin module 1 above by means of the bolt 30*c*.

Figure 4A:
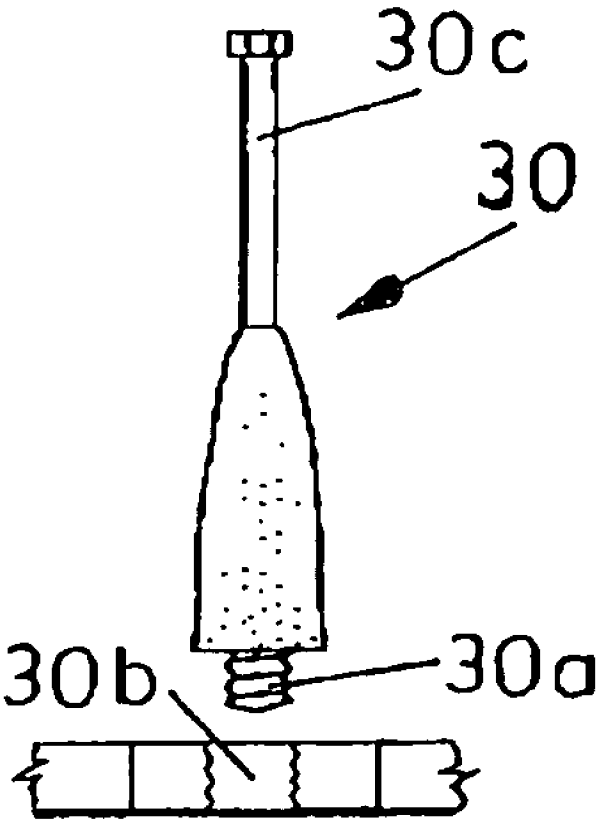
FIG. 4*a* is a diagrammatic representation of a grommet for vertical connection of two building modules.
Figure 4B:
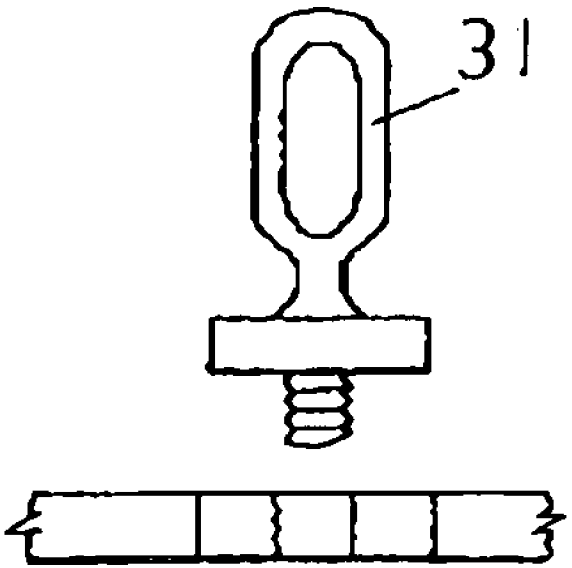
FIG. 4*b* is a diagrammatic representation of a lifting hook.

FIG. 4*b* illustrate that the half grommet fixing 30 interchangeable with a lifting eye 31 that can be secured to lifting tackle when the cabin modules 1 are to be moved.

The cabin and corridor modules 1, 2 of the building structure may be supported and secured against the elements by one of many different foundation structures, none of which is depicted here. The integral strength of the tetragonal structure renders it versatile of use with different foundation systems. For example, for medium and long term applications metal rings attached to jacking legs of the module may be placed in the ground and filled with concrete. Alternatively for soft or snow covered ground skids may be secured to the module with half grommet fixings. For swamp land, and inland water and areas prone to flooding floatation rafts such as polystyrene blocks encapsulated in concrete surrounds are secured to the module with half grommet fixings. In environments where high wind pressure may be a problem the modules may be fitted with spreading bars that are secured to the module with half grommet connectors. The bars are generally in the form of angle irons submerged just below ground surface, extending outwardly on each side of the module. These spreading bars may be used in conjunction with other foundation structures if necessary.

For smaller building structure complexes the gap between the modules and ground may enclosed by boarding and filled with polystyrene. This foundation may be of particular use in areas liable to flooding and also provides for an aesthetic finish. Whilst polystyrene is appropriate for light weight and quick response applications other forms of mineral in-fill may be used for different applications. The type of infill and the pressure of this fill is selected accordingly.

The advantage of such a foundation system is that it can be positioned directly on to most ground surfaces without the need for the ground surface to be completely flat or level; or for grass, or similar vegetation, to be removed.

The construction of such a foundation is effected in the following stages:

1. The first stage is necessary in applications where high wind conditions are possible.

Spreading bars are positioned just below the ground surface, and are adequately secured with ground screws or sinkers, etc., vertical grommet fastenings (extended in length) are screwed to the spreading bars at intervals corresponding to the bottom wall connection points.

2. A series of sausage shaped flotation bags (each bag extending as long as the width of the module, and approximately of a third of a meter in diameter, and being divided into separate internal chambers) are laid out across the site so that each module will be supported by at least two flotation bags.

Plastic hessian type sackings are laid between the flotation bags such that when expanded they are sufficiently large to fill the gap between two flotation bags.

3. Ground floor modules are then assembled in their designated formation, over the bags, and are temporarily supported on blocks, sufficient to allow the horizontal grommet fastenings between modules to be loosely engaged, and the extended vertical grommers to be positioned in the leg housing.

4. The floatation bags are then inflated (using an air pump equipped with a multiple outlet manifold and individual pressure gauges) sufficiently to lift the loose assembly gradually off the ground. Approximate levelling is achieved through adjusting the pressures in the appropriate chambers of the appropriate floatation bags.

Working from one end of the assembly to the other, the horizontal grommers are tightened into position, until the total assembly is secured into horizontal alignment.

The floating assembly can then be finally levelled, and raised or lowered to the desired height.

5. The plastic hessian type sackings, between the flotation bags, are then filled with expanding polystyrene foam, sufficient to fill cavities between the floatation bags, while temporary barriers prevent expansion outwards from the sides of the assembly. The expanding foam is applied in equal pressure in each sack (to a pressure less than that in the floatation bags).

6. After the foam has consolidated, the pressure in the floatation bags is then released and the modular assembly settles on to the polystyrene foundation.

The floatation bags are deflated and pulled clear; after which the hollows that are left are filled with expanding polystyrene foam.

7. The vertical grommet bolts, securing the modules to the spreader bars, are tightened into position.

The upper stories of the building can then be assembled.

Finally, when the building is complete, the vertical grommers are re-tightened.

The advantage of this foundation system, over conventional footings, is seen in the difference in the speed and the cost construction. In addition the system, provides for improved insulation and, in view of the filing of the space under the modules, improved aesthetic value and security.

Figure 5:
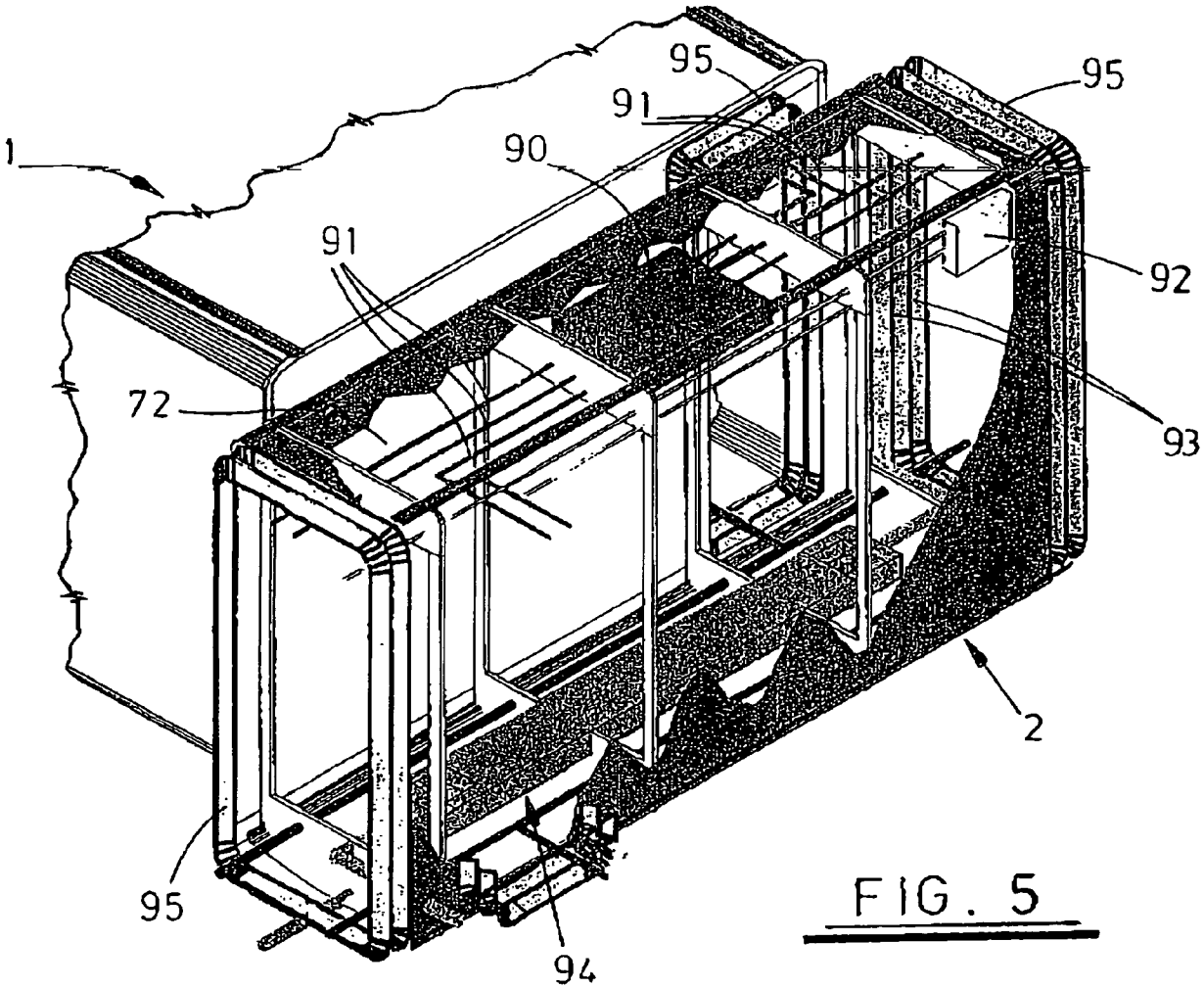
FIG. 5 is a perspective view of a corridor of the modular building, the corridor being shown partially cut-away and connected to a building module.

FIG. 5 shows part of a corridor module 2 connected to a transversely disposed cabin module 1. The corridor 2 is represented partially cut-away so as to expose service supplies that are carried to each cabin module 1. As mentioned earlier, the structure of the corridor 2 is the same as that described in relation to the cabin modules 1. In the ceiling cavity 11 there is an air conditioning plant 40 including conduits as shown at 41 and an electrical supply installation 42 and corresponding wiring 43. A domestic water supply and waste disposal system is carried in the floor cavity 10 as indicated at 44. The corridor modules 2 define walkways that extend across adjacent corridor modules 2 or between corridor 2 and cabin modules 1. Gaps between connected modules are bridged around the walkway area by flexible bellows-type walkway couplings 45.

Figure 6:
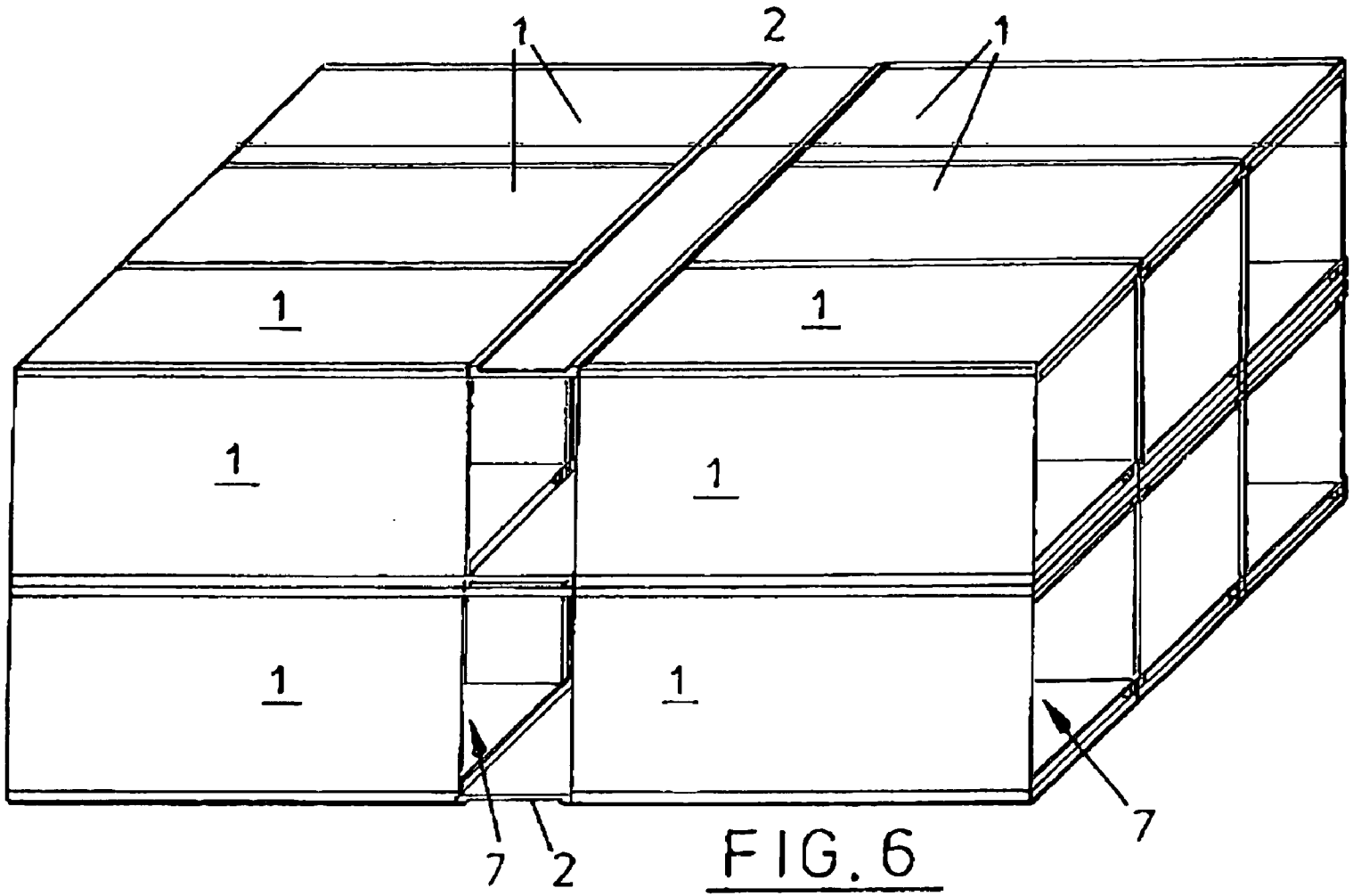
FIG. 6 is a perspective view of a two storey modular building in accordance with the present invention.

An example of a two storey modular building structure is shown in FIG. 6. The structure comprises two vertically stacked central corridor modules 2, each storey flanked by six cabin modules 1 (three on each side). The modules are interconnected horizontally by the fixing arrangements shown in FIG. 2 and vertically by the half grommet fixings of FIG. 4*a*.

In addition, horizontal grommet fixings extend between the edges of the open ends 7 of each module and the side wall of the corridor module 2.

Figure 7:
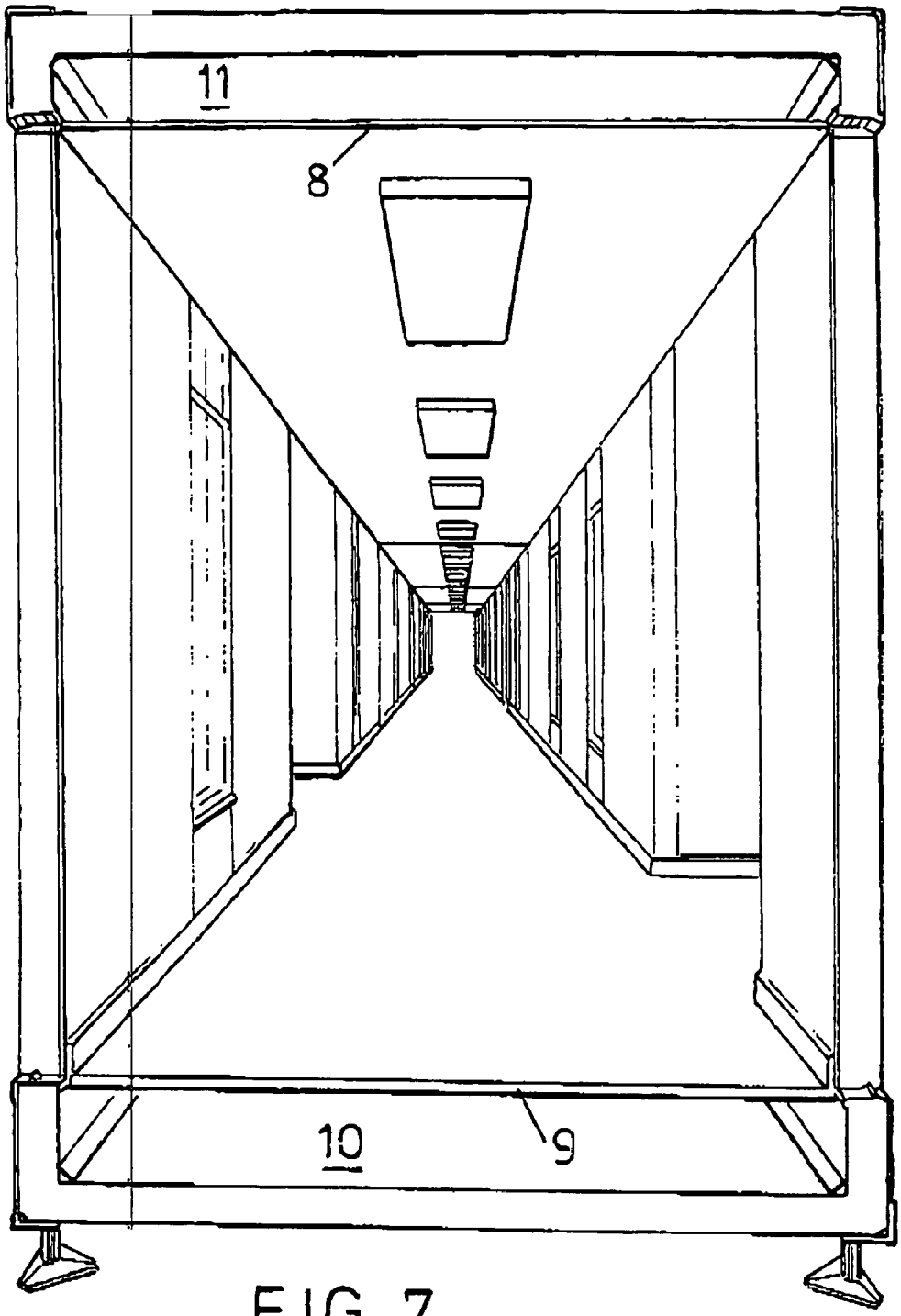
FIG. 7 is an end view of a furbished corridor module with end walls removed for clarity.

A fully constructed and furbished corridor module is shown in FIG. 7 with the end shown open to expose the ceiling and floor cavities 10, 11.

Figure 8:
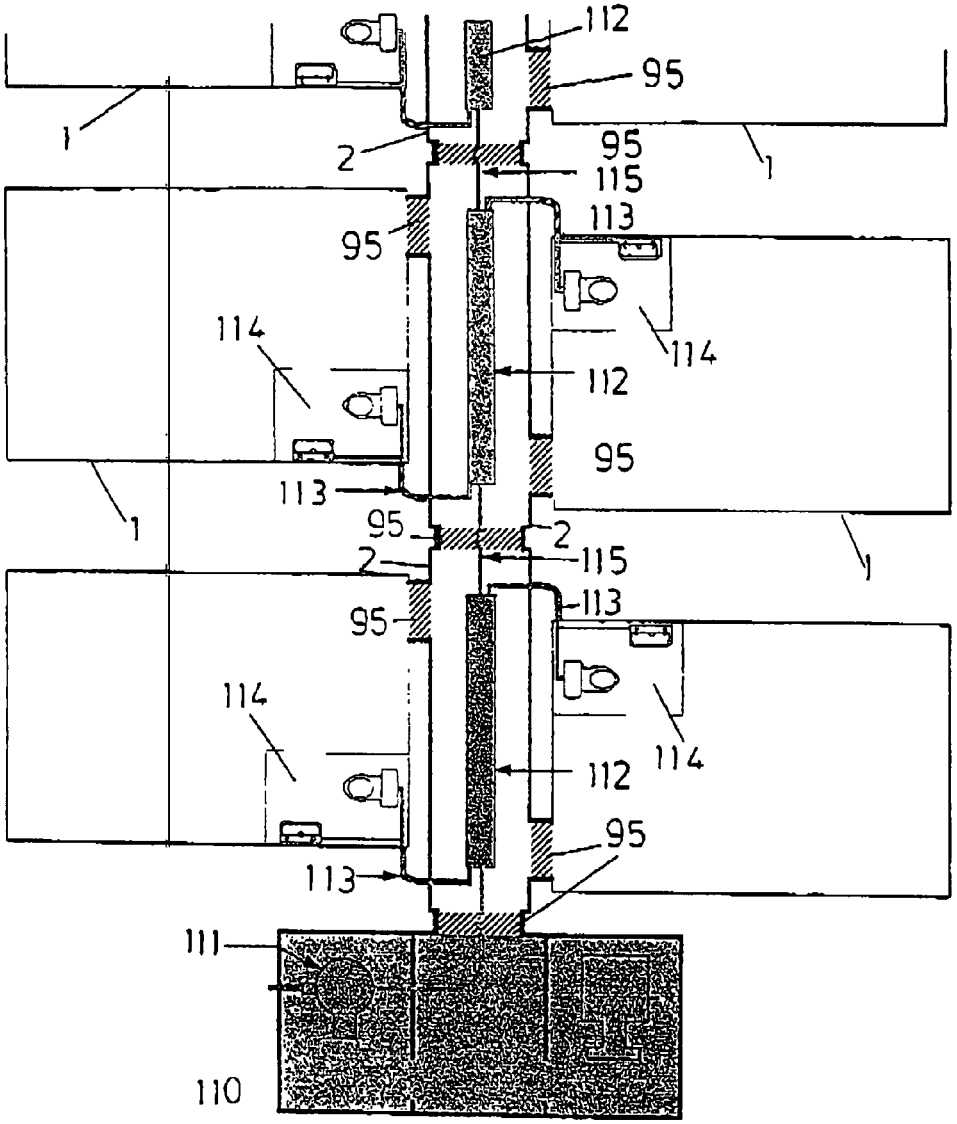
FIG. 8 is a schematic representation of an embodiment of a modular building of the present invention, showing a sewage system.

An example of a waste disposal system for a building structure of the present invention is shown in FIG. 8. The system is shown in relation to a corridor comprising three axially joined corridor modules 2 and six cabin modules 1 connected on each side of the corridor 2. A service module 110 containing a suction pump and tank 111 is connected to an end of the corridor 2. Each corridor module 2 has a holding tank 112 in its floor cavity. Each tank 112 has flexible conduits 113 that are connected to a lavatory and wash area 114 of each cabin module 1 and adjacent holding tanks 112 are interconnected by a suction waste pipe 115. The figure also shows the flexible bellows coupling 95 between each corridor module 3 and between each cabin 1 and corridor module 2.

Figure 9:
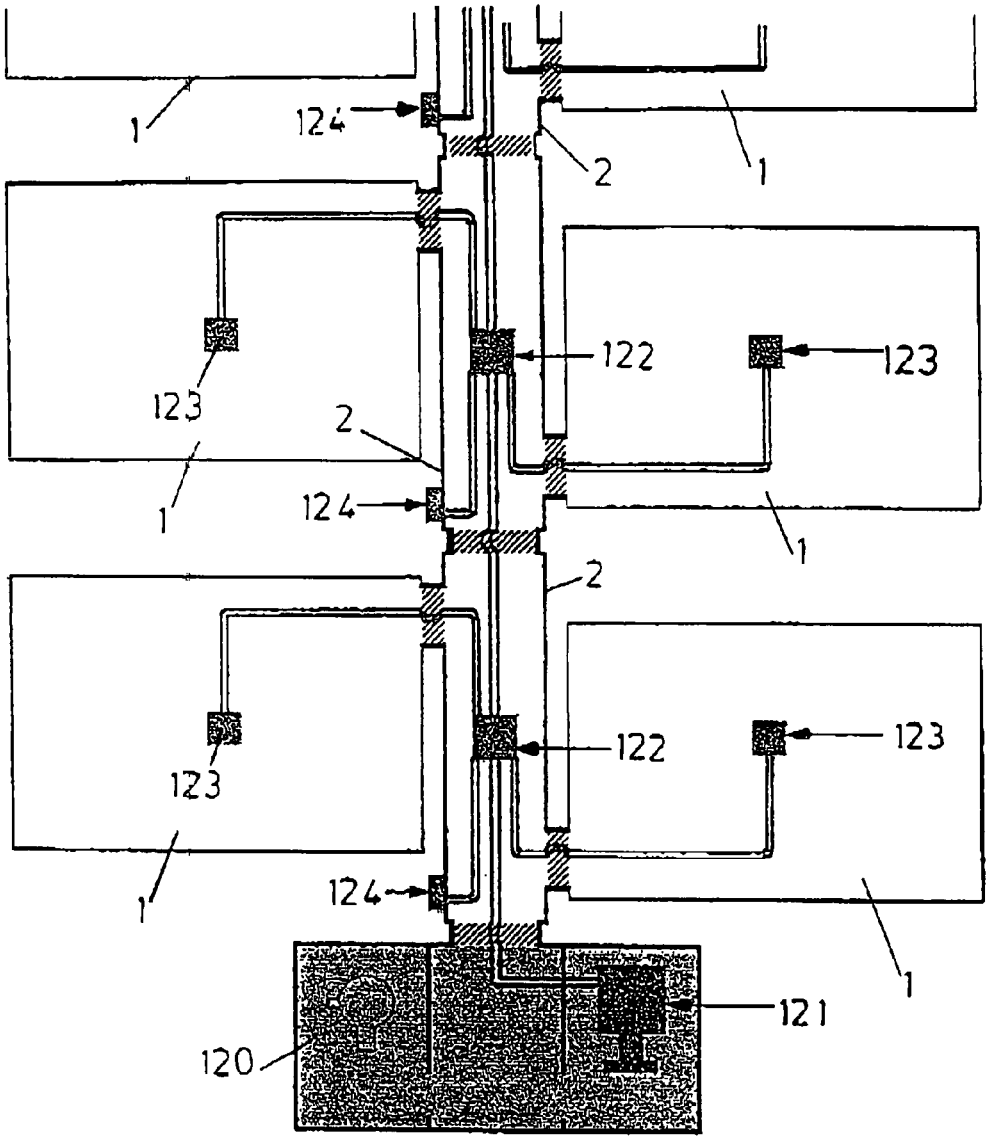
FIG. 9 is a schematic representation of an embodiment of a modular building of the present invention showing an air conditioning system.

In FIG. 9, there is shown an exemplary air conditioning system depicted in relation to part of a building structure comprising a central corridor constructed from three axially connected corridor modules 2 and six cabin modules 1, three on each side of the corridor 2. At one end of the corridor 2 there is a service module 120 containing a central plant 121 that feeds a heat exchanger 122 in the immediately adjacent corridor module 2. Further heat exchangers 122 are located in each corridor module 2, each heat exchanger 122 being connected to that of the adjacent corridor module 2 and to further heat exchangers 123 situated in each adjacent cabin module 2. An exhaust heat pump 124, connected to the corridor heat exchanger 122, is located outside each corridor module 2. Besides the central air conditioning plant the service module 121 may also contain central alarm and security control systems, service repair and spare equipment, telephone transmission and reception equipment, television reception apparatus, a fresh water distribution manifold, and, in the case of remotely located building structures, electrical generators.

Using corridors of this type it is possible to provide accommodation for short term applications without the need to provide pathways, foundations or to conduit preliminary ground excavation for drains and service supply lines. The investment generally made in creating such facilities are therefore not lost when relocating the building structure. The arrangement also enables building complexes to be sited on sloping or undulating sites without the need for gravity waste disposal. Any noisy equipment is conveniently located in the corridors leaving the cabin modules free of noise, vibration and clutter. The air conditioning also provides protection from outside interference (which is particularly desirable in noisy, dusty environments) as well as reducing condensation.

The standard cabin or corridor modules may be adapted as necessary depending on how they are to be used. For example, the corridor rooves may be made in a double-glassed construction to provide a conservatory. Ancillary structures such as, for example, fire escapes, balconies, canopies and exterior walkways may be connected to the modules by the grommet fixing arrangements described above.

Figures 10, 11:
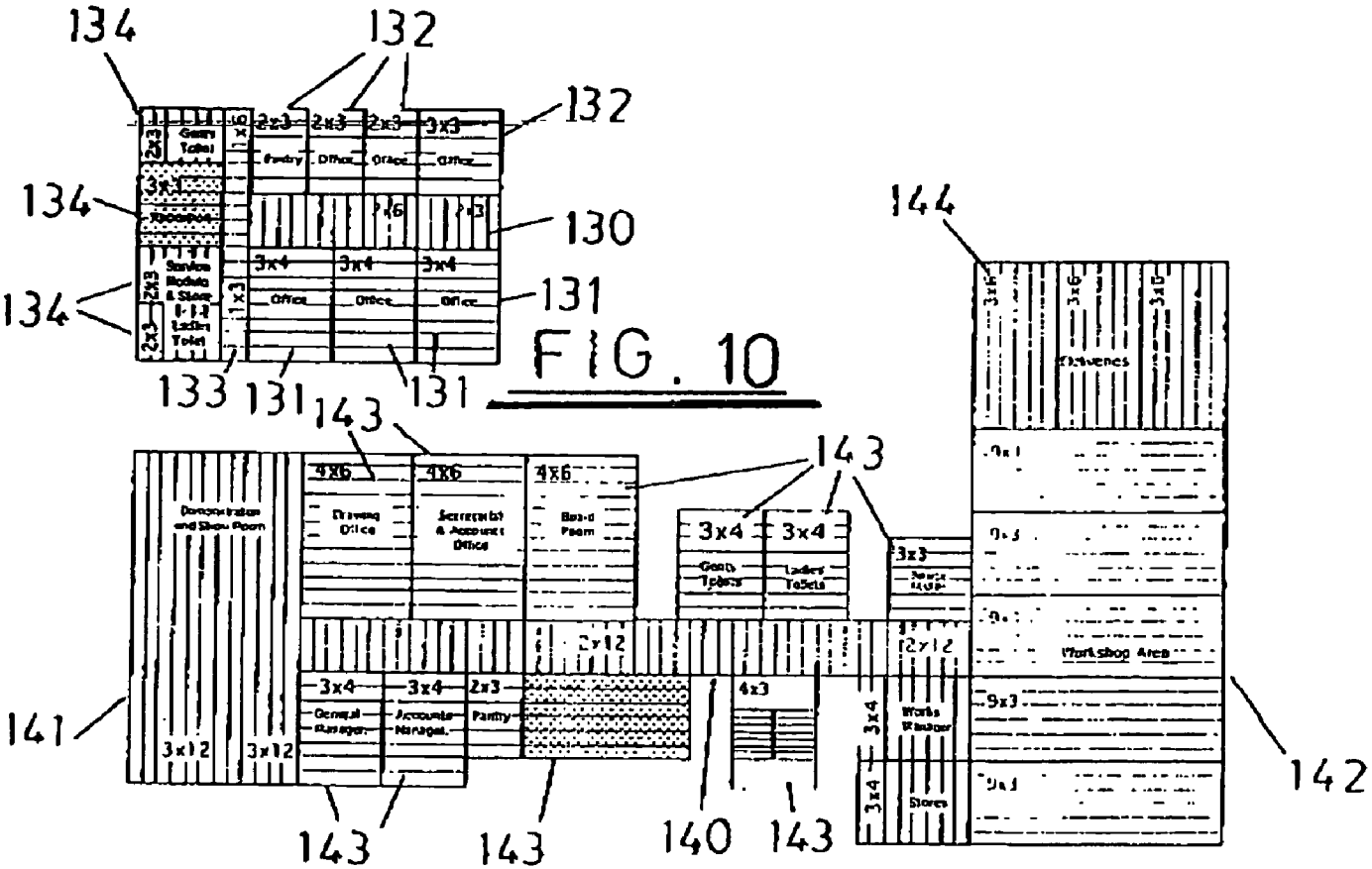
FIG. 10 shows a diagrammatic layout of a modular office block building.
FIG. 11 shows a diagrammatic layout of a modular building forming a factory with offices.

The modular nature of the corridor and cabin modules means that many different building layouts are possible. Examples are shown in FIGS. 10 and 11. The former shows a layout an office block having a first corridor 130 with three office cabin modules 131 on one side and four cabin modules 132 on the other side designated for three smaller offices and a pantry. One end of the first corridor module 130 meets a transversely extending second corridor module 133 which is connected to four cabin modules 134 that are furbished as toilets, a reception area, and a service module with store.

In FIG. 11 there is shown an example layout for a factory with offices. A central corridor 140 comprising two modules interconnects a demonstration and show room 141 comprising two side-by-side cabin modules at one end and a workshop area 142 comprising five side-by-side cabin modules at the other end of the corridor 140. Cabin modules 143 of various sizes connect to the corridor on each side and are furbished as offices, lavatories, a service modules and a pantry. The workshop area 142 is connected to three cabin modules defining a delivery area 144.

Broadly speaking the on-site procedure for constructing a building of this type is as follows:

a) the service module is delivered to the site and placed in the correct location;
b) the foundations are laid down with access roads, car parking, boundary fences etc.;
c) the cabin modules and corridor modules are delivered and secured to the foundations and to each other; and
d) the mains service supplies are routed from the service module along the corridor floor and ceiling cavities through to the cabin modules and the building is tested for occupation.

The building structures of the present invention differ from previous prefabricated buildings in that they are manufactured in their entirety in modular format together with completed interiors. The buildings are comparatively lightweight, do not have an overall superstructure and require only limited foundations. In view of the modular surface the on-site construction is less complicated and more rapid that conventional buildings. The range of module sizes allows for all buildings to be assembled from factory produced units.

The open-ended tetragonal structure of each module can be fitted with a choice of standard end sections that serve to determine the module identity and purpose, e.g. a compartment module, a corridor module, a container etc. The simple tetragonal cabin module is transformed into a number of mutations by mixing a range of standard modules with a range of standard end sections, as above. These modules can then be combined together into different formations to produce buildings that are all uniquely different.

The integrity of individual modules combined into the cumulative strength of honeycomb building, is further aided by the foam cushioning foundations and the elasticity tolerance in the inter modular fastening. The honeycomb structure in comparison to bricks and mortar, or iron frame construction, is less prone to collapse. If sections of honeycomb building are destroyed then the remaining structure can provide sufficient support to maintain the rest of the building in situ.

One of the main advantages is the considerable cost reduction for manufacturing buildings of this kind. A considerable quantity of variable applications can be constructed from comparatively few basic building blocks. The system provides factory finished interiors and internal services which are generally of a higher quality and cheaper to produce than those constructed on-site. The speed and simplicity with which the honeycomb structure building can be erected dramatically reduces the construction time and costs. In addition there is a significant reduction in pre-building costs such as those expended in employing architects, surveyors, site management etc.

The construction of the cabins is suitable for mass production giving both labour and materials cost advantages. The different sizes of module produced by using differing dimensions of the same product means and incorporating different end sections that many different markets can be supplied without creating the need for different manufacturing processes.

Bare cabins (with the floor, ceiling and end sections fitted) can be delivered to special outfitters where they are furnished before being transported to the construction site.

Transportation of the modules is simplified as they are lightweight and strong enabling them to be placed and moved on a lightweight trailer rather than a heavy duty vehicle. The structure of the modules is such that they can be transported on their sides if necessary. The modules are also suitable for air transport to inaccessible locations or in military applications or circumstances where a quick response in required (e.g. emergencies such as natural disasters).

Once built, the building structure can later be modified, expanded or reconfigured to suit changing requirements relatively simply. In addition, the building structure can be relocated in whole or in part with ease.

Since the component modules are of standard design, the building structure lends itself well to simple computer modelling and virtual reality systems that enable layout planning. The simplicity would also enable the end user of the building to participate in the design of the building.

The modular nature of the building enables it to be enlarged or reduced in size as appropriate. This may have advantage for both the residential and commercial market. For example, first time residential buyers will be able to start with a small one bedroom house, expand the size of the building over time by adding extra modules as the family grows and reduce the size of the building by removing modules as the family size diminishes. The style of the house can be constructed to suit the owner's preferences. Similarly, in the commercial realm the size of the building can be varied throughout its life to reflect the growth or diminishing size of the business.

Similarly, disused modular buildings can be diminished and removed so that ugly, dilapidated or vandalised buildings can be quickly removed. A minimum disturbance to land structure means that land can be returned to green site conditions after the buildings have been removed.

Valuing property for sale or financing purposes is simplified in that the value of the property is no longer restricted by its location and design and can be easily assessed by the aggregate value of its component parts while the site is valued separately in terms of size and location.

The present invention provides for improved durability in prefabricated buildings of about 40 years with a higher standard of interiors and internal services as compared to the 15 years for existing structures.

What is claimed is:

1. A modular building structure comprising: a corridor module defining a plurality of connection openings; a plurality of inhabitable building modules each having a first end with an opening, said first end of each building module being connected to the corridor module at a respective connection opening such that the opening of the building module is in communication with the connection opening of the corridor module, the corridor module containing apparatus for the supply and distribution of at least one mains service to the building modules, each building module being free-standing, and being connected to said supply of at least one mains service, wherein the corridor module has a floor defining a walkway that links and provides access to said connection openings such that it is possible to walk from the walkway through a connection opening and said opening in said first end of said building module and into a building module, wherein the service module is sectional so that it can be extended or shortened to provide more or less connection nodes as required.

2. A modular building structure comprising: a corridor module defining a plurality of connection openings; a plurality of inhabitable building modules each having a first end with an opening, said first end of each building module being connected to the corridor module at a respective connection opening such that the opening of the building module is in communication with the connection opening of the corridor module, the corridor module containing apparatus for the supply and distribution of at least one mains service to the building modules, each building module being free-standing, and being connected to said supply of at least one mains service, wherein the corridor module has a floor defining a walkway that links and provides access to said connection openings such that it is possible to walk from the walkway through a connection opening and said opening in said first end of said building module and into a building module, wherein there is provided a plurality of service modules, some modules being disposed in a direction transverse to others.

3. A modular building structure according to claim 2, wherein the mains service is for waste disposal and each service module is provided with a holding tank that is connected to a lavatory or wash area of an adjacent building module.

4. A modular building structure according to claim 3, wherein holding tanks of adjacent service modules are connected by a suction waste pipe.

5. A modular building structure comprising: a service module defining a plurality of connection openings, a plurality of building modules each having a first end with an opening, said first end of each building module being connected to the service module at a respective connection opening such that the opening of the building module is in communication with the connection opening of the service module, the service module containing apparatus for the supply and distribution of at least one mains service to the building modules, each building module being free-standing, and being connected to said supply of at least one mains service, wherein the service module is in the form of a corridor walkway linking the building modules, wherein each adjoining pair of building modules or service modules has apparatus for connecting adjacent modules, the apparatus comprising a housing a defining apertures that extend into the structure of each module and a flexible resilient insert that is snugly received in each aperture and bridges the two modules, the insert being supported on a fixing element that is secured to each of the modules.

6. A modular building structure comprising: a service module defining a plurality of connection openings, a plurality of building modules each having a first end with an opening, said first end of each building module being connected to the service module at a respective connection opening such that the opening of the building module is in communication with the connection opening of the service module, the service module containing apparatus for the supply and distribution of at least one mains service to the building modules, each building module being free-standing, and being connected to said supply of at least one mains service, wherein the service module is in the form of a corridor walkaway linking the building modules, comprising multiple storeys, vertically adjacent modules being connected by a connecting member comprising a resilient flexible insert attached to one module and received in an aperture of the vertically adjacent module.

7. A method for constructing a modular building structure, the method comprising: preparing a site on which the building structure is to be located; installing a corridor module on the prepared site, the corridor module defining a plurality of connection openings each for connection to a respective separative inhabitable building modules; each building module having a first end with an opening therein; installing at least one mains supply service to the corridor module; connecting at least one pre-constructed building module to the corridor module at a connection opening therein such that the connection opening is in communication with said opening in said first end; connecting the building module to the mains supply service of the corridor module; and furnishing the corridor module such that it is in the form of a corridor walkway linking the building modules and providing access to said connection openings such that it is possible to walk from the walkway through a connection opening and said opening in said first end of said building module and into a building module.

8. A method according to claim 7, comprising further steps of filling a clearance between the module and ground.

9. A modular binding structure comprising: first and second adjacent building modules, each with apertures that extend into the structure of the building modules, a first fixing member attached to said first building module and extending into its aperture and a second fixing member attached to said second building module and extending into its aperture, and a flexible resilient insert interconnecting said fixing members and bridging the building modules, wherein each module comprises an access chamber that is open to the inside of the module so as to facilitate insertion of the fixing members and flexible inserts.

10. A modular building structure according to claim 9, wherein the insert is received in each aperture.

11. A modular building structure according to claim 9, wherein the fixing members and insert are disposed in a floor a ceiling cavities in the building modules.

12. A modular building structure comprising: first and second adjacent building modules, each with apertures that extend into the structure of the building modules, a first fixing member attached to said first building module and extending into its aperture and a second fixing member attached to said second building module and extending into its aperture, and a flexible resilient insert interconnecting said fixing members and bridging the building modules, wherein the insert is a grommet.

13. A modular building structure comprising: a service module defining a plurality of connection openings, a plurality of building modules each having a first end with an opening said first end of each building module being connected to the service module at a respective connection opening such that the opening of the building module is in communication with the connection opening of the service module, the service module containing apparatus for the supply and distribution of at least one mains service to the building modules, each building module being free-standing, and being connected to said supply of at least one mains service, wherein the service module is in the form of a corridor walkway linking the building modules, wherein the service module has floor and ceiling cavities in which the mains service supplies are routed, wherein the building modules have floor and ceiling cavities for receipt of the mains service supplies.

14. A modular building structure according to claim 1, wherein the modules are connected.

15. A modular building structure according to claim 1, wherein the mains service supply is air conditioning and each service module is fitted with a heat exchanger and has an external pump for evacuation of warm air.

16. A modular building structure according to claim 1, wherein the mains service is for waste disposal and each service module is provided with a holding task that is connected to a lavatory or wash area of an adjacent building module.

17. A modular building structure according to claim 1, wherein one building module is a dedicated plant room that feeds the mains supply service to the service module.

18. A modular building structure according to claim 1, wherein the service module has floor and ceiling cavities in which the mains service supplies are routed.

19. A modular building structure according to claim 2, wherein the modules are connected.

20. A modular building structure according to claim 2, wherein the mains service supply is air conditioning and each service module is fitted with a heat exchanger and has an external pump for evacuation of warm air.

21. A modular building structure according to claim 2, wherein one building module is a dedicated plant room that feeds the mains supply service to the service module.

22. A modular building structure according to claim 2, wherein the service module has floor and ceiling cavities in which the mains service supplies are routed.

23. A modular building structure according to claim 5, wherein the mains service is for waste and each disposal and each service module is provided with a holding tank that is connected to a lavatory or wash area of an adjacent building module.

24. A modular building structure according to claim 5, wherein the modules are connected.

25. A modular building structure according to claim 5, wherein the mains service supply is air conditioning and each service module is fitted with a heat exchanger and has an external pump for evacuation of warm air.

26. A modular building structure according to claim 5, wherein one building module is a dedicated plant room that feeds the mains supply service to the service module.

27. A modular building structure according to claim 5, wherein the service module has floor and ceiling cavities in which the mains service supplies are routed.

28. A modular building structure according to claim 6, wherein the modules are connected.

29. A modular building structure according to claim 6, wherein the mains service supply is air conditioning and each service module is fitted with a heat exchanger and has an external pump for evaluation of warm air.

30. A modular building structure according to claim 6, wherein the mains services is for waste disposal and each service module is provided with a holding tank that is connected to a lavatory or wash area of an adjacent building module.

31. A modular building structure according to claim 6, wherein one building module is a dedicated plant room that feeds the mains supply service to the service module.

32. A modular building structure according to claim 6, wherein the service module has floor and ceiling cavities in which the mains service supplies are routed.

33. A modular building structure according to claim 12, wherein the insert is received in each aperture.

34. A modular building structure according to claim 12, wherein the fixing members and insert are disposed in a floor ceiling cavities in the building modules.

* * * * *

UNITED STATES PATENT AND TRADEMARK OFFICE

CERTIFICATE OF CORRECTION

PATENT NO. : 6,925,761 B1
DATED : August 9, 2005
INVENTOR(S) : Peter W. De La Marche It is certified that error appears in the above-identified patent and that said Letters Patent is hereby corrected as shown below:

Column 12,
Line 19, please delete “task” and insert in lieu thereof -- tank --.
Line 62, please delete “evaluation” and insert in lieu thereof -- evacuation --.

Column 14,
Line 2, please insert -- or -- immediately after the word “floor”.

Signed and Sealed this

Fifteenth Day of November, 2005

JON W. DUDAS
*Director of the United States Patent and Trademark Office*